US006866084B2

(12) United States Patent
Åsholt et al.

(10) Patent No.: US 6,866,084 B2
(45) Date of Patent: Mar. 15, 2005

(54) METHOD AND MEANS FOR PRODUCING MOULDED FOAM BODIES

(75) Inventors: Petter Åsholt, Sunndalsøra (NO); Gunnar Tokle, Sunndalsøra (NO)

(73) Assignee: Cymat Corporation, Mississauga (CA)

( * ) Notice: Subject to any disclaimer, the term of this patent is extended or adjusted under 35 U.S.C. 154(b) by 0 days.

(21) Appl. No.: 10/227,238

(22) Filed: Aug. 26, 2002

(65) Prior Publication Data

US 2003/0051850 A1 Mar. 20, 2003

Related U.S. Application Data

(63) Continuation of application No. PCT/NO01/00072, filed on Feb. 23, 2001.

(30) Foreign Application Priority Data

Feb. 25, 2000 (NO) ..... 2000 0973

(51) Int. Cl.[7] ..... B22D 25/00; B22D 27/00
(52) U.S. Cl. ..... 164/79
(58) Field of Search ..... 164/79

(56) References Cited

U.S. PATENT DOCUMENTS

| | | | | |
|---|---|---|---|---|
| 3,214,265 A | | 10/1965 | Fiedler | |
| 3,297,431 A | | 1/1967 | Ridgway, Jr. | |
| 3,300,296 A | | 1/1967 | Hardy et al. | |
| 3,329,198 A | * | 7/1967 | Manning et al. | 164/119 |
| 3,367,401 A | * | 2/1968 | Bonis et al. | 164/306 |
| 3,689,048 A | * | 9/1972 | Foulard et al. | 266/220 |
| 3,843,353 A | | 10/1974 | Niebylski | |
| 3,940,262 A | | 2/1976 | Niebylski et al. | |
| 4,099,961 A | | 7/1978 | Patten | |
| 4,618,427 A | | 10/1986 | Venås | |
| 5,281,251 A | | 1/1994 | Kenny et al. | |
| 5,865,237 A | | 2/1999 | Schorghuber et al. | |
| 6,090,232 A | | 7/2000 | Seeliger et al. | |

FOREIGN PATENT DOCUMENTS

| | | |
|---|---|---|
| DE | 4326982 C1 | 2/1995 |
| EP | 0 483 184 B1 | 1/1994 |
| GB | 892934 A | 4/1962 |
| WO | WO 91/01387 A1 | 2/1991 |
| WO | WO 92/21457 A1 | 12/1992 |
| WO | WO 94/09931 A1 | 5/1994 |

OTHER PUBLICATIONS

G. Davies et al., "Review Metallic Foams: Their Production, Properties and Applications," Journal of Material Science, 1983, pp. 1899–1911, No. 18.

* cited by examiner

*Primary Examiner*—Kuang Y. Lin
(74) *Attorney, Agent, or Firm*—Cahn & Samuels, LLP

(57) ABSTRACT

Present invention relates to a method and means for producing moulded bodies of a metal foam (9), in particular an aluminium foam. The Method involves the use of mould (1) having a cavity (8) and at least one entrance opening (3). The mould id filled with a metal foam in a manner where the entrance opening of the mould is submerged into a metal melt (4) and the melt is caused to foam inside the mould (1) and fill its cavity (8).

22 Claims, 2 Drawing Sheets

METHOD AND MEANS FOR PRODUCING MOULDED FOAM BODIES

This application is a continuation application of PCT Application No. PCT/NO01/00072, filed on Feb. 23, 2001 (which designates the United States and was published on Aug. 30, 2001), which claims priority from Norwegian application number 20000973, filed on Feb. 25, 2000. These patent applications are hereby incorporated by reference.

Present invention relates to a method and means for producing moulded bodies of metal foam, in particular an aluminium foam.

Up to present, several techniques have been proposed for the production of three-dimensional bodies of metal foam. For instance in U.S. Pat. No. 5,865,237 there is disclosed a method for making foam casting objects where a volume of foaming compacts of a powder metal and a gas-evolving foaming agent is heated in a chamber. When at least partial foaming occurs, the contents is forced into a mould cavity where residual foaming is permitted.

In Norwegian Patent No. 304359 there is disclosed a method for casting articles by heating a metal matrix composite that contains finely dispersed solid stabilising particles to a temperature above the solidus temperature for the metal matrix. Gas bubbles are introduced into the melted metal composite beneath the surface thereof, whereby a stabilised flowable metal foam is obtained on the surface of the metal composite. Further, the stabilised metal foam that is in a liquid state is thereafter forced into a form cavity where it is allowed to cool and solidify.

These methods implies that the foam is forced or pressed into the mould cavity. In dependency of the shape of the mould cavity, inhomogenity in the foamed body may occur as a result of restricted inflow and frictional forces between the moving metal and the internal mould walls in the cavity under the filling operation. In addition, related to complex tree dimensional shapes of the cavity, there can be problems with insufficient filling of the mould causing that the cast product will not be complementary with the mould cavity.

According to the present invention, there is provided a novel and simplified method of forming three-dimensional castings of foamed metal, where problems of the above mentioned type can be minimised.

In the following, the invention shall be further described by examples and figures where:

Figure 1:
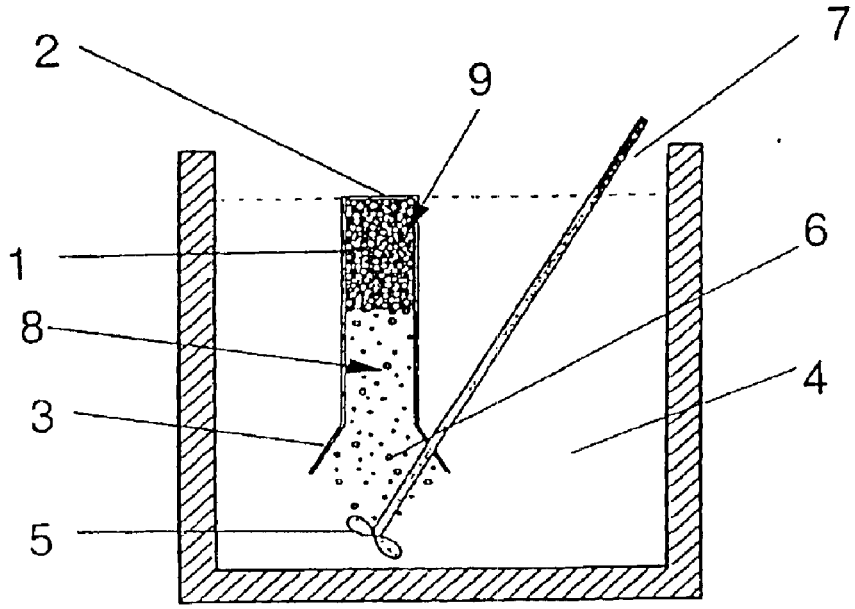
FIG. 1 shows a mould completely submerged into a melt.

In FIG. 1 the mould 1 consists of a vertically arranged cylindrical shell with a closed top 2. The mould shown here is completely submerged, and its cavity 8 is filled with melt 4 before the melt is foamed. The lower part of the cylindrical mould is formed as a diverging or conical shell representing the entrance 3 of the mould. In the melt, below the entrance of the mould there is arranged a rotor impeller 5 of a type that delivers gas through outlets in the vicinity of the impeller or through outlets in the impeller itself. The impeller 5 rotates about an axle 7 that may comprise an internal pipe for leading gas to the impeller (not shown). Under the foaming process the delivered cellulating gas forms bubbles 6 that rises upwards and enters the mould 1. The bubbles continue to rise until they reach the upper end wall 2 of the mould. There the bubbles accumulate, and after a period of foaming the melt in the mould will be completely foamed. In the figure, foamed metal 9 is indicated in the upper half-section of the mould.

It should be understood that the above mentioned principle of gas injection, which is commonly known by those skilled in the art and further described in the applicants own patent application WO 91/01387, may be substituted by other ways of gas injection that will generate foaming. The use of a porous plug in this sense will be described later.

Coalescence of the bubbles accumulated in the mould can be avoided by addition of refractory particles in the melt matrix that reinforce the bubble walls. As shown in the example, the mould is completely filled with melt before the foaming starts up. This results in the fact that no air will be present in the mould before foaming which contributes to reduce possible friction between the foam and the mould walls during the moulding process that may cause unwanted structural deformations of the foam.

Figure 2:
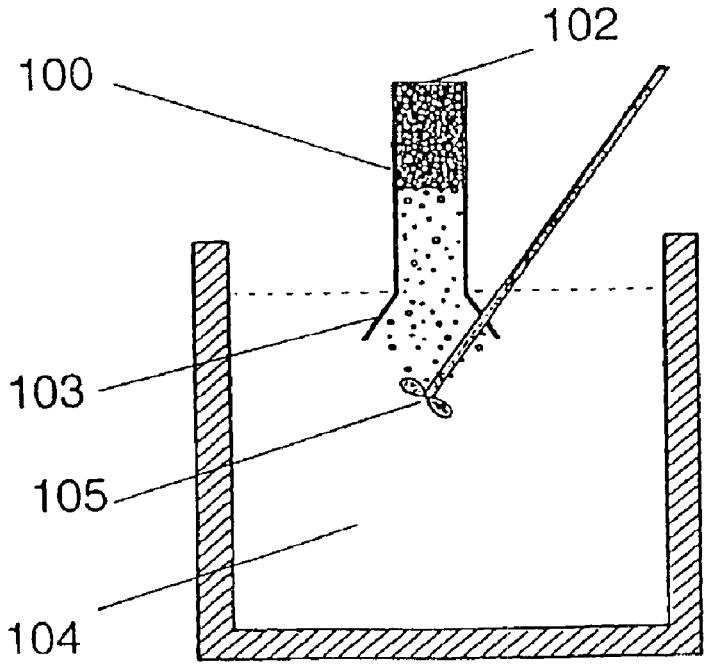
FIG. 2 shows a mould semi submerged into a melt.

In a second embodiment which is shown in FIG. 2 a mould 100 is semi-submerged into a melt 104, where the entrance 103 of the mould is located beneath the surface of the melt. The mould in this embodiment has the same shape as that of FIG. 1, with a top 102 and a diverging or conical open entrance 103. In this situation the foaming of the melt by the rotor impeller 105 will start following that the mould cavity has been sufficiently filled with molten metal.

Figure 4:
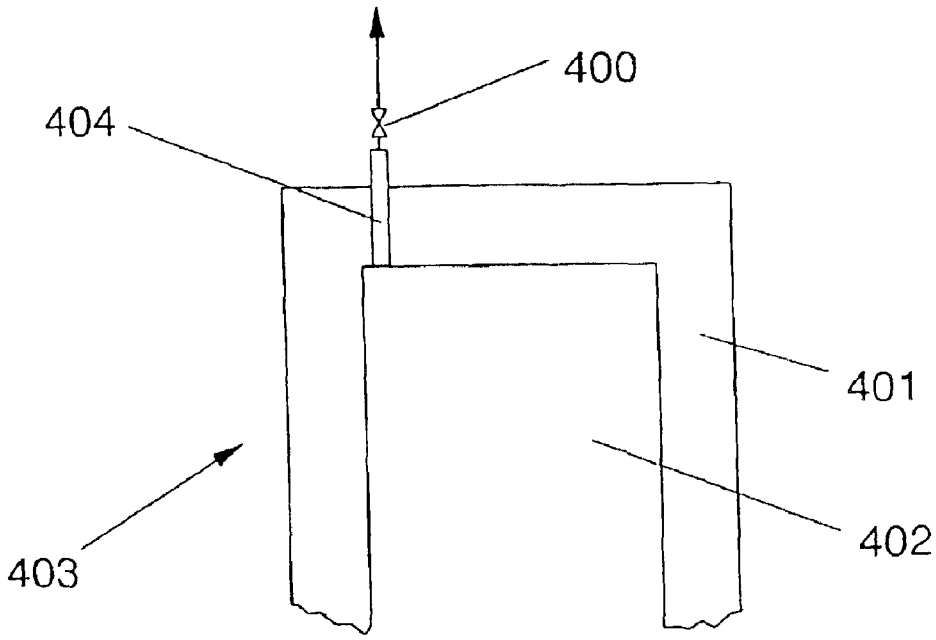
FIG. 4 shows the upper part of a mould having an air outlet.

As indicated in FIG. 4, the mould 403 may in addition be provided with an air outlet or evacuating means in the top thereof for evacuating air before and/or under appropriate periods of the melt filling and foaming operation, to assist the level increase in the cylinder to be higher than the level of the ambient melt. Such evacuating means may comprise a controllable outlet such as an air vent screw or a valve 400. The figure shows an upper part of the mould 403 with a cavity indicated by 402. The mould wall 401 is penetrated in its upper region by a pipe 404 connected with the valve 400. The valve 400 may further be connected with evacuating means such as a vacuum pump (not shown).

An alternative way of filling the mould with melt without the use of specific air evacuating means is to turn the mould upside down and back again while it is submerged in the melt.

Alternatively, the mould may be dividable into two or more parts (not shown). The latter will ease filling of the mould with melt before foaming, and make the casting of complex three dimensional components available. With a dividable mould, the mould should preferably be divided during submerging in the melt to ease filling. After submerging, the mould is closed by sliding the parts together, leaving a fully filled cavity. After foam filling the mould is lifted from the melt to solidify the foam body, and the mould is again divided to remove the foam body.

After the foaming process where the melt inside the mould is replaced by foamed metal, a lid or the similar may preferably be placed under the bottom part to ensure that the net shape foam component still in liquid or semi solid state does not fall out as the mould is fully extracted from the melt to solidify and cool the foam inside.

The mould may preferably be preheated before being submerged in the melt in order to reduce dead time before foam filling. This could be done by integrated heating elements in the mould, for instance electric heating elements. Alternatively, the mould or mould parts could be heated in a separate chamber. Likewise, the mould could be equipped with an integrated cooling circuit to cool the mould subsequent to foam filling to reduce time for solidification before the foam body is removed from the mould.

During experiments, it was observed that surface quality varies along the length of the cast components. This is due to the fact that the mould was fixed at the same vertical level during the foaming operation. As the best surface quality was found near the bottom of the components, it is assumed that the observed differences in surface quality is closely linked to the metallostatic pressure in the position where the surface is created. The foam bodies produced by this method have a smooth outer surface in the parts of it that solidifies next to the mould walls, while the interior of the foam body is, of course, porous. An improvement of the all over surface quality is therefore assumed to be achieved if the mould is elevated during foam filling in such a way that the lowermost foam inside is always at the same depth. In this way, the pressure will always be the same where the new foam is accumulated. The mould may be lowered and elevated by an electric hoisting apparatus (not shown).

In the above standing examples there is disclosed a mould of cylindrical shape, but it should be understood that other geometrical shapes can be applied as well.

With the present method, one can cast an aluminium core inside another (hollow) metallic part or the similar, e.g. foam filling inside a steel tube in a crash box for energy absorption applications where the steel tube will serve as the mould in the manufacturing process. Provided that the metallic part can survive staying in the melt for some time (as it is or with some surface treatment), one could imagine to fill such components directly by the present method. This would rationalise the manufacturing process of foam filled hollow components significantly.

Figure 3:
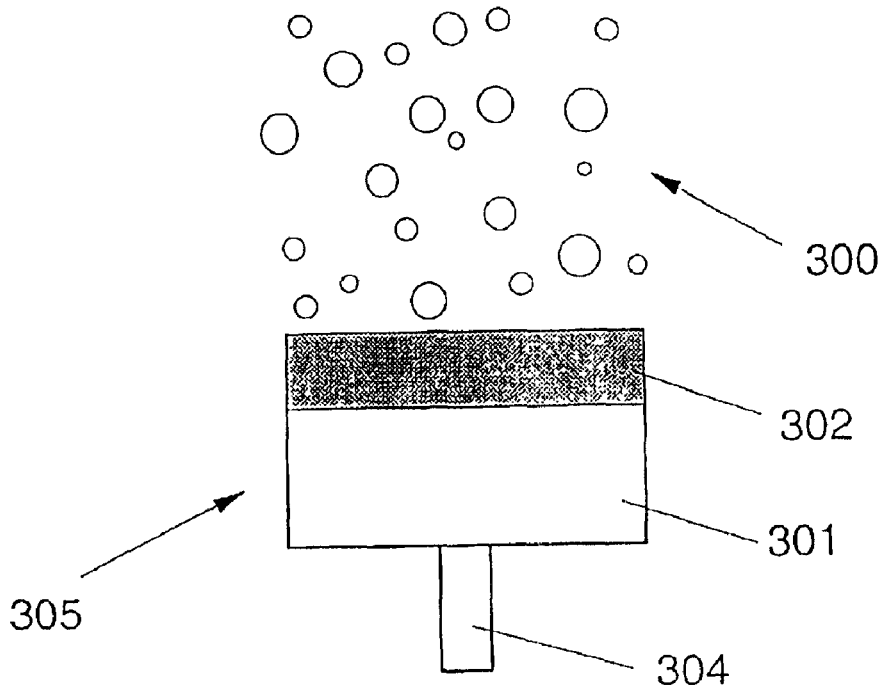
FIG. 3 shows a porous plug generating bubbles.

Yet another possibility is to use another source for generating the bubbles for foaming, for instance porous plugs or plates, where the gas is injected into the melt from these devices. This could ease the process control as the gas could more easily be turned on and off when needed, for instance in the dead time during mould exchanges. FIG. 3 shows this principle for generating foam, where a gas generating device 305 generates bubbles 300 in a melt. The device comprises a porous plug 302, for instance of a ceramic medium or other appropriate material, arranged above a gas distribution chamber 301 having a gas inlet 304. The principle is that the foaming gas is forced through the porous ceramic medium, leading to bubble formation on the opposite side i.e. in the melt.

It should be understood that in accordance with the present method other varieties of products can be made, such as tubes and other products with hollow cross-sections. Even products having cross-sections with an U-profile can be made by the method. This can be implemented by the arrangement of an insert in the mould before filling (not shown).

As will be understood on the basis of the above standing paragraphs, the mould itself can preferably be of a re-usable type, or it can simply be a part of the component intended to receive the foam.

What is claimed is:

1. A method for producing a discrete moulded body of a foamed metal comprising providing a mould (1) having a generally closed cavity (8), having the general shape of the body being formed, and at least one entrance opening (3);

completely filling the mould cavity with a molten metal;

filling the mould cavity with a foam (9) by accumulation of bubbles rising through the molten metal (4), while keeping at least the entrance opening (3) submerged in the molten metal;

cooling the mould to solidify the foam in said cavity;

opening the mould; and removing the formed body.

2. A method in accordance with claim 1, wherein the mould (1) is raised vertically during foaming.

3. A method in accordance with claim 1, wherein the mould is evacuated before and/or under the filling/foaming process.

4. A method in accordance with claim 1, wherein the bubbles are generated by a foaming means (5, 305) arranged in the molten metal (4) below the entrance opening (3) of the mould (1).

5. The method according to claim 1 wherein refractory particles are added to the molten metal prior to generating said foam.

6. The method according to claim 1 wherein said mould is pre-heated prior to introducing said foam.

7. The method according to claim 1 wherein said mould is completely submerged in said molten metal.

8. The method according to claim 1 wherein said mould is partially submerged in said molten metal.

9. The method according to claim 1 wherein any air in said mould is vented through a vent provided on said mould.

10. The method according to claim 1 wherein the lowermost portion of said foam is maintained at the same depth in the molten metal.

11. The method according to claim 1 wherein said mould comprises a hollow article to be filled with said foam.

12. A method of filling a hollow metal article with an aluminum foam, said article having at least one opening into the hollow interior thereof, the method comprising:

positioning said article above a molten aluminum bath, said article being positioned so as to maintain at least said opening submerged in the molten aluminum;

completely filling the interior of said article with the molten aluminum;

generating an aluminum foam by introducing air in said molten aluminum;

allowing said foam to enter the interior of said hollow article, through said opening, thereby causing displacement of said molten aluminum;

removing said article from the bath and allowing the foam to cool and harden.

13. A method of producing a discrete moulded body of a foamed metal in a mould having a generally closed cavity, having the general shape of the body being formed, and at least one opening into said cavity, the method comprising:

providing a heated bath containing a molten metal, the bath also including a gas injection means;

positioning said mould above said bath wherein at least said opening is maintained submerged in the molten metal, the opening being positioned above said gas injection means;

completely filling the mould with the molten metal:

generating a metal foam by introducing air in said molten metal through said gas injection means;

allowing said foam to enter into the mould cavity through said opening;

cooling said mould to cause said foam to cool and harden within said mould;

opening said mould and removing the formed body.

14. The method according to claim 13 wherein any air contained in the mould is released through a vent in the mould during filling with said molten metal or said foam.

15. The method according to claim 13 wherein said mould is raised during generation of said foam.

16. The method according to claim 13 wherein refractory particles are added to the molten metal prior to generating said foam.

17. The method according to claim 13 wherein said mould is pre-heated prior to introducing said foam.

18. The method according to claim 13 wherein said mould is completely submerged in said molten metal during filling with said molten metal.

19. The method according to claim 13 wherein said mould is partially submerged in said molten metal.

20. The method according to claim 13 wherein any air in said mould is vented through a vent provided on said mould.

21. The method according to claim 13 wherein the lowermost portion of said foam is maintained at the same depth in the molten metal.

22. The method according to claim 13 wherein said mould comprises a hollow article to be filled with said foam.

* * * * *